US006513655B2

(12) United States Patent
Logan et al.

(10) Patent No.: US 6,513,655 B2
(45) Date of Patent: Feb. 4, 2003

(54) BLISTER PACKS

(75) Inventors: Alan George Logan, North Ringwood (AU); Phillip John Gould, Heathmont (AU)

(73) Assignee: Cetram Pty Limited, Victoria (AU)

( * ) Notice: Subject to any disclaimer, the term of this patent is extended or adjusted under 35 U.S.C. 154(b) by 0 days.

(21) Appl. No.: 09/865,494

(22) Filed: May 29, 2001

(65) Prior Publication Data

US 2002/0014431 A1 Feb. 7, 2002

(30) Foreign Application Priority Data

May 29, 2000 (AU) ..... 37769/00

(51) Int. Cl.[7] ..... B65D 75/78
(52) U.S. Cl. ..... 206/469; 206/467
(58) Field of Search ..... 206/461–463, 206/467–470, 459.5; 220/359.2, 359.3

(56) References Cited

U.S. PATENT DOCUMENTS 3,621,989 A * 11/1971 Pregont ..... 206/468
4,739,883 A * 4/1988 Mohs et al. ..... 206/467
4,842,141 A * 6/1989 Segal ..... 206/462
4,915,289 A * 4/1990 Hatano et al. ..... 220/359.3
5,209,354 A * 5/1993 Thornhill et al. ..... 206/469
5,277,920 A * 1/1994 Weaver, Jr. ..... 206/469
5,407,066 A * 4/1995 Grange ..... 206/467
6,039,495 A * 3/2000 Zimmerman et al. ..... 206/467
6,276,529 B1 * 8/2001 Feehan, Jr. ..... 206/469

FOREIGN PATENT DOCUMENTS

JP 10059416 3/1998

* cited by examiner

*Primary Examiner*—Jim Foster
(74) *Attorney, Agent, or Firm*—Lowe Hauptman Gilman & Berner, LLP

(57) ABSTRACT

A blister pack comprises a support card with a transparent plastics blister at the rear of the card. The card closes an open side of the blister to enclose product within the blister. The front face of the card is laminated with a transparent plastics sheet and includes a window through which the contents of the blister can be viewed from the front of the pack.

13 Claims, 2 Drawing Sheets

BLISTER PACKS

BACKGROUND OF THE INVENTION

1. Field of the Invention

The present invention relates to blister packs, for example for small items of hardware such as screws, nails, bolts, or wall anchors.

2. Description of the Prior Art

Blister packs for small items of hardware such as those just discussed conventionally comprise a transparent plastics blister attached to a sheet of relatively thin card which rigidifies the pack and facilitates suspension of the pack from a hanger of a point-of-sale display. The card will usually be printed with appropriate data concerning the product within the pack. The pack is configured so that on the point-of-sale display, the blister is at the front so that the contents within the blister are clearly visible to the customer, with the card closing the rear of the blister, access to the contents being afforded by tearing the card for which purpose the card is usually provided with perforations.

SUMMARY OF THE INVENTION

According to the invention, there is provided a blister pack, said pack comprising a support card with a transparent plastics blister at the rear of the card, the card closing an open side of the blister to enclose product within the blister, the front face of the card being covered with a transparent plastics sheet and including a window through which the contents of the blister can be viewed from the front of the pack, the plastics sheet providing a closure for the window and the sheet being removable from the card to open the window for withdrawal of the product via the open window.

Further according to the present invention, there is provided a blister pack, said pack comprising a support card with a transparent plastics blister at the rear of the card, the card closing an open side of the blister to enclose product within the blister, the front face of the card being laminated with a transparent plastics sheet over substantially its entire area and including a window through which the contents of the blister can be viewed from the front of the pack, wherein the front face of the card is printed with indicia relating to the product and viewable through the transparent plastics sheet and the transparent plastics sheet is laminated to the front of the card by a compound which penetrates into the outer surface portion of the card whereby opening of the pack can be effected by pulling the plastics sheet and the surface portion of the card adhering thereto away from the remainder of the thickness of the card so as to open the window for withdrawal of product via the window without requiring tearing of the card to increase the open area of the window.

BRIEF DESCRIPTION OF THE DRAWINGS

An embodiment of the invention will now be described, by way of example only, with reference to the accompanying drawings in which.

DESCRIPTION OF THE PREFERRED EMBODIMENT

Figure 1:
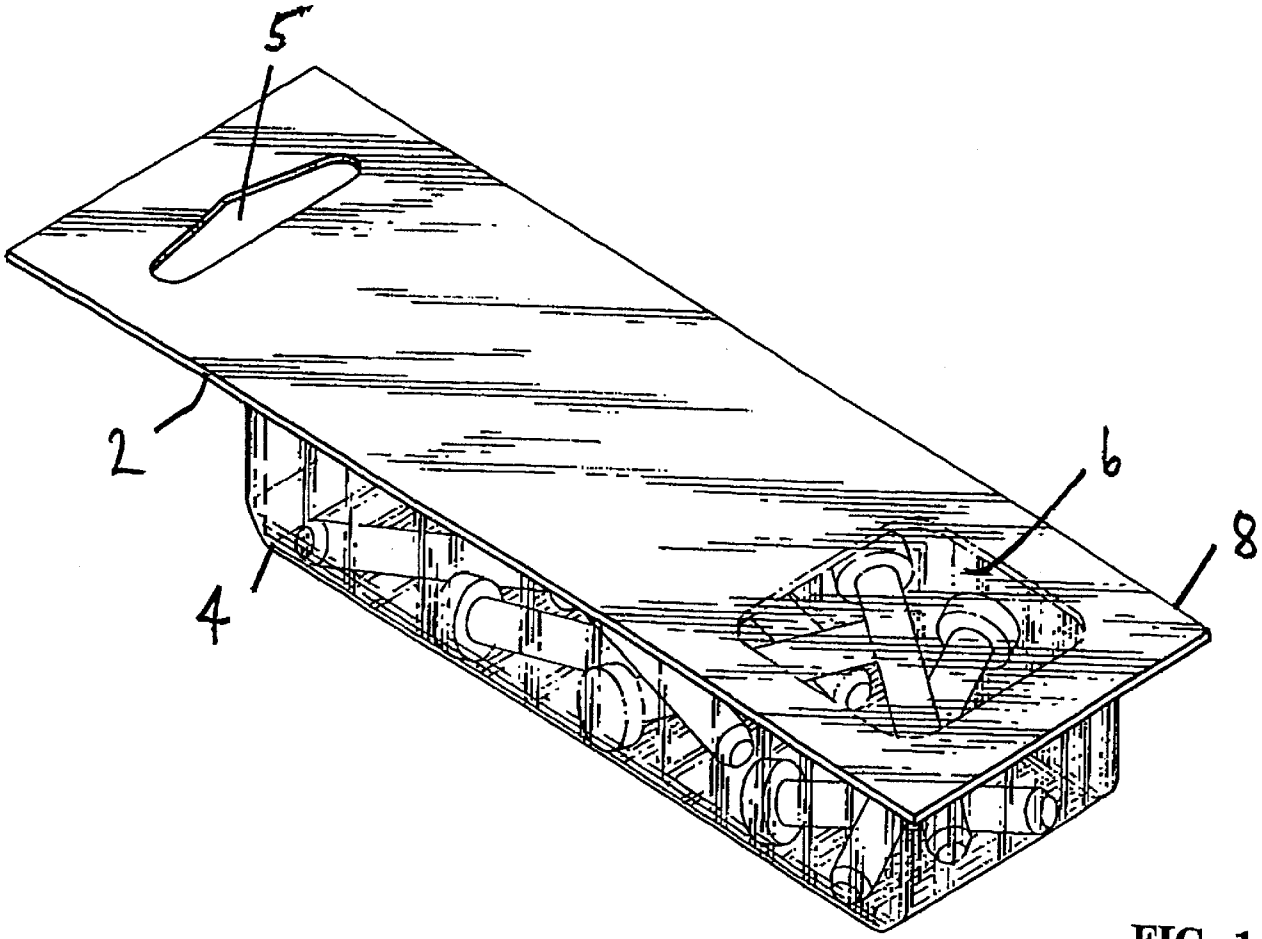
FIG. 1 is a perspective view of a blister pack in accordance with a preferred embodiment of the invention, the pack being shown prior to opening.
Figure 2:
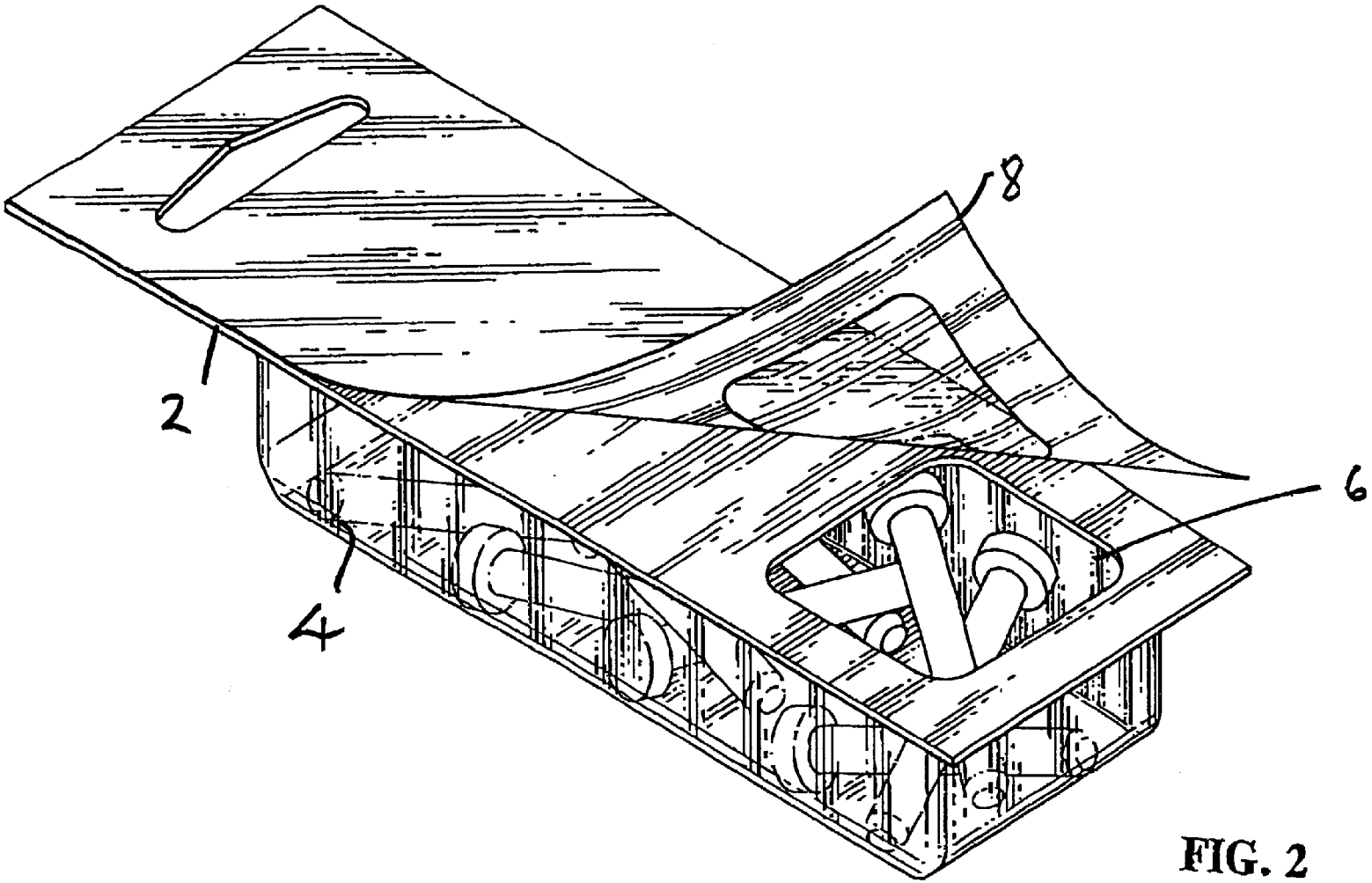
FIG. 2 is a perspective view showing the pack after opening.

In accordance with the preferred embodiment of the invention, a blister pack for small items of hardware such as those discussed at the outset comprises a card 2 carrying a transparent blister 4 of a semi-rigid plastics material, the card 2 closing the open side of the blister 4. In contrast to conventional blister packs of this general type, the card 2 is designed to lie at the front of the blister 4 when the pack is hung via a suspension aperture 5 or otherwise mounted in the point-of-sale display, and to facilitate viewing of the contents the card 2 is provided with a window 6 through which the contents within the pack can be observed by a customer viewing the pack from the front. The detailed structure of the pack will now be described with reference to the following description of the method by which the pack is produced.

The pack is manufactured using the following process steps:

1. The front and rear sides of the card 2 are printed.
2. One or more coats of heat seal compound are applied to the front and rear faces of the card 2.
3. The aperture for forming the window 6 is cut within the card 2, for example using a die cutting process.
4. The front of the card 2 is laminated with a transparent plastics film or other transparent plastics sheet 8 using a heat sealing process by applying heat and pressure.
5. The card and the suspension aperture 5 is cut, for example using a die cutting process, followed by stripping of the suspension aperture 5.
6. The blister 4 is adhered to the back of the card 2 using a heat seal blister machine.

In the step of laminating the front of the card 2 with the transparent plastics film 8, the heat seal compound bonds through the printed surface of the card to the fibres lying adjacent the surface of the card. In order to open the pack, all that is necessary is to lift a corner of the laminate 8 and pull the laminate away from the card in the zone of the window 6. In so doing, a thin surface layer of the card to which the laminate 8 is adhered will simply tear away from the remainder of the card thickness. Product can then be withdrawn via the open window 6.

Although suitable plastics for use as the film 8, and suitable heat seal compounds for laminating the film to the front of the card will be well known and understood to those skilled in the art, by way of example in a preferred form the film is P.E.T. of a thickness of from about 50 micron to 75 micron, and the heat seal compound is polyurethane-based water soluble having a temperature sealing range through the film of from 110° C. to 130° C.

Although opening of the pack is accomplished very easily by a consumer in the manner just described, nevertheless the laminated structure of the card reinforces the card and provides a secure closure for the window to reduce the risk of pilferage of product when the pack is within the point-of-sale display. In contrast, conventional packs of the type discussed at the outset are highly susceptible to pilferage of product while within the point-of-sale display by pressing the blister at the front of the card to force a product against the card which is readily torn due to the presence of the perforations. In a pack in accordance with the invention, the card is not weakened by the presence of perforations as these are not needed. Instead, the dispensing window of predetermining dispensing size is always present, but is closed by the secure closure formed by the laminate.

The design of the pack described whereby the card lies at the front of the pack with the contents being visible through the small window 6 at the front of the card provides a display in which substantial product information printed on the front of the card is immediately visible to a potential customer without having to remove the pack from the display. In contrast in current packs in which the blister lies to the front of the card in the display, the blister and the contents within the blister tend to obscure some of the data visible at the front face of the card.

The embodiment has been described by way of example only and modifications are possible within the scope of the invention.

What is claimed is:

1. A blister pack, comprising a support card carrying a transparent plastics blister at the rear of the card, the card closing an open side of the blister to enclose product within the blister, the front face of the card being covered with a transparent plastics sheet and including a window through which the contents of the blister can be viewed from the front of the pack, the plastics sheet providing a closure for the window and the sheet being removable from the card to open the window for withdrawal of the product via the open window.

2. The blister pack of claim 1, wherein the card is directly adhered to the blister.

3. The blister pack of claim 2, wherein the card remains adhered to the blister after removal of the sheet.

4. The blister pack of claim 1, wherein the sheet is not directly bonded to the blister.

5. The blister pack of claim 1, wherein the card and the sheet have substantially the same size.

6. The blister pack of claim 1, wherein the sheet is releasably laminated with the card.

7. The blister pack of claim 1, wherein a mechanical strength of the card is substantially unchanged throughout a region thereof corresponding to the blister, except for the window.

8. The blister pack of claim 1, wherein the card is formed without weakened points in a region thereof corresponding to the blister, except for the window.

9. The blister pack of claim 1, wherein the card is formed without perforation in a region thereof corresponding to the blister, except for the window.

10. The blister pack of claim 1, wherein the front face of the card is printed with indicia relating to the product and viewable through the transparent plastics sheet.

11. The blister pack of claim 1, wherein the sheet is made of PET and has a thickness ranging from about 50 to about 75 micron, the sheet is laminated to the card by a heat seal polyurethane-based water soluble compound having a sealing temperature ranging from about 110 to about 130° C.

12. A blister pack, comprising a support card with a transparent plastics blister at the rear of the card, the card closing an open side of the blister to enclose product within the blister, the front face of the card being covered with a transparent plastics sheet and including a window through which the contents of the blister can be viewed from the front of the pack, the plastics sheet providing a closure for the window and the sheet being removable from the card to open the window for withdrawal of the product via the open window;

wherein the transparent plastics sheet is laminated to the card and remains permanently adhered to a surface portion of the card whereby removal of the plastics sheet is effected by tearing the sheet and the surface portion of the card adhering thereto away from the remainder of the thickness of the card.

13. A blister pack, said pack comprising a support card with a transparent plastics blister at the rear of the card, the card closing an open side of the blister to enclose product within the blister, the front face of the card being laminated with a transparent plastics sheet over substantially its entire area and including a window through which the contents of the blister can be viewed from the front of the pack, wherein the front face of the card is printed with indicia relating to the product and viewable through the transparent plastics sheet and the transparent plastics sheet is laminated to the front of the card by a compound which penetrates into the outer surface portion of the card whereby opening of the pack can be effected by pulling the plastics sheet and the surface portion of the card adhering thereto away from the remainder of the thickness of the card so as to open the window for withdrawal of product via the window without requiring tearing of the card to increase the open area of the window.

* * * * *